United States Patent [19]

Evans

[11] 4,419,914

[45] Dec. 13, 1983

[54] CANT PRODUCTION

[76] Inventor: Tony L. Evans, P.O. Box 415, Ozark, Mo. 65721

[21] Appl. No.: 965,386

[22] Filed: Nov. 28, 1978

[51] Int. Cl.[3] ..... B27B 5/34; B27B 31/04

[52] U.S. Cl. ..... 83/407; 83/422; 83/423; 83/425.4; 83/449; 83/435.2; 83/508.3; 83/708; 144/378; 198/411

[58] Field of Search ..... 83/35, 407, 404, 425.4, 83/435.2, 508.3, 422, 446, 447, 423, 708, 449; 144/312 R; 198/411, 412

[56] References Cited

U.S. PATENT DOCUMENTS

| | | | |
|---|---|---|---|
| 336,782 | 2/1886 | Barnes | 83/425.4 X |
| 408,790 | 8/1889 | Butler | 83/422 |
| 714,098 | 11/1902 | Caldwell | 83/425.4 |
| 1,724,042 | 8/1929 | Price | 83/425.4 |
| 1,835,041 | 12/1931 | Hagmaier et al. | 83/422 |
| 2,591,568 | 4/1952 | Lorimer | 83/435.2 X |
| 2,821,220 | 1/1958 | Nicholson | 83/422 |
| 2,961,015 | 11/1960 | Randall | 83/508.3 |
| 3,141,482 | 7/1964 | Arness | 83/422 X |
| 3,184,034 | 5/1965 | Stuller et al. | 83/435.2 X |
| 3,408,886 | 11/1968 | David | 83/157 X |
| 3,459,246 | 8/1969 | Ottosson | 144/312 R |
| 3,516,539 | 6/1970 | Gulstrom et al. | 198/411 X |
| 3,645,304 | 2/1972 | Thrasher | 83/508.3 X |
| 3,710,836 | 1/1973 | Busch | 83/425.4 X |
| 3,722,343 | 3/1973 | Cornell | 83/422 |
| 3,788,180 | 1/1974 | Potsch et al. | 83/449 |
| 3,828,635 | 8/1974 | Smith | 83/425.4 X |
| 3,961,547 | 6/1976 | Shainberg et al. | 83/425.4 X |
| 4,022,094 | 5/1977 | Hetherington | 83/422 X |
| 4,037,502 | 7/1977 | Westfall | 83/425.4 X |
| 4,146,072 | 3/1979 | Detjen | 144/312 |

*Primary Examiner*—Frank T. Yost

*Attorney, Agent, or Firm*—Cushman, Darby & Cushman

[57] ABSTRACT

A method of forming cants slabbed on four sides from logs, and a sawmill assembly for effecting formation of the cants. First and second in-line sets of pairs of saws are provided, and a log is fed to the first set of saws in a horizontal direction, the first set of saws slabbing two opposed sides of the log. The log is continuously fed from the first set of saws to the second set of saws in the same horizontal direction, and the log is rotated 90° about an axis along the horizontal direction during feeding from the first set to the second set of saws. The second set of saws slab two opposed sides of the log after 90° rotation thereof, and a cant slabbed on four sides is thus formed. The distance between the pairs of saws of each set is adjustable by automatic detenting from one spacing to another, and the scrap is carried away from saw sets by conveyors outside of the saw sets.

13 Claims, 15 Drawing Figures

Fig. 7.
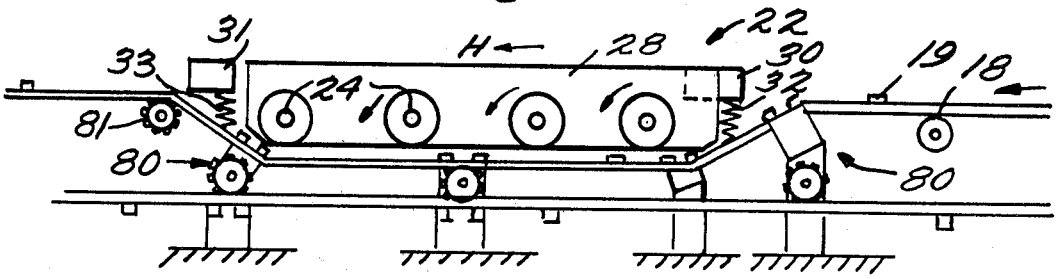
Fig. 4.
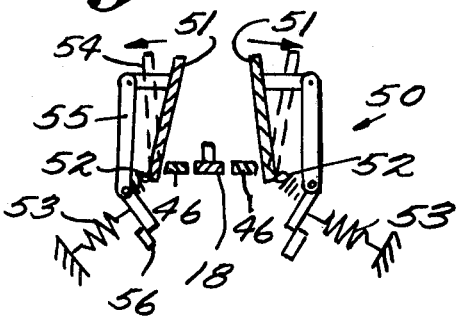
Fig. 6a.
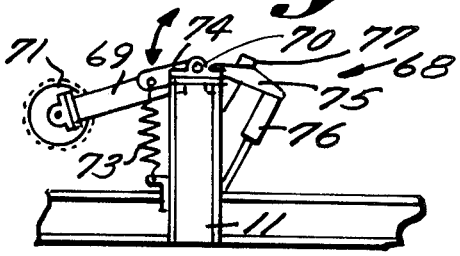
Fig. 9a.
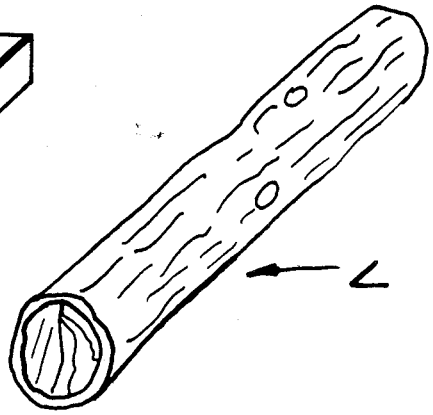
Fig. 9b.
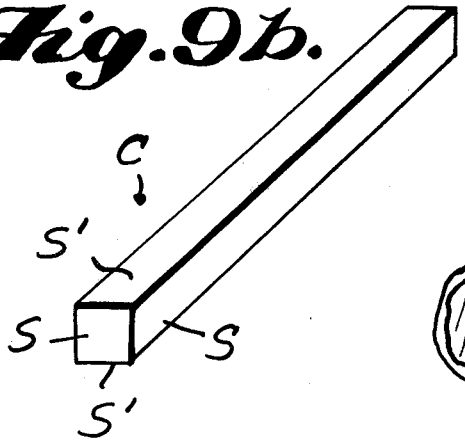
Fig. 10a.
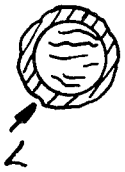
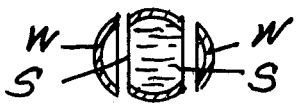
Fig. 10b.
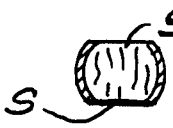
Fig. 10c.
Fig. 10d.
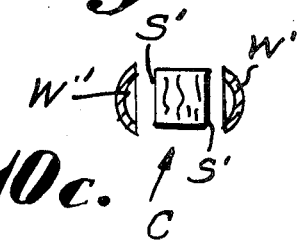

CANT PRODUCTION

BACKGROUND AND SUMMARY OF THE INVENTION

The invention relates to a method and apparatus for foming cants slabbed on four sides from logs. In the trade today, the common manner of forming cants is to pass a log through a set of saws, slabbing two sides thereof, and then taking a log and passing it through the saws again to slab the other sides of the log. Any adjustment to the spacing of the saws is made by rotating a hand crank to slowly and incrementally move the saws toward and away from each other. Such common procedures is the trade are inefficient, very labor-intensive per unit of production, and are not capable of achieving high rates of production. There have been proposals (see U.S. Pat. No. 2,669,262) for forming cants automatically utilizing a single machine by mounting pairs of saws on a moveable carriage, and moving the carriage back and forth across a bed for supporting the saws while moving the logs and partially-slabbed cants from one position to another. However, such proposals have not met with widespread industry acceptance, perhaps because of the difficulty of mounting two pairs of saws on a moveable carriage and properly controlling the movement of the logs from one position to another.

According to the present invention, a method of forming cants slabbed on four sides at a high rate of production, and a sawmill assembly for practicing the method, are provided which overcome the problems inherent in prior art arrangements. According to the present invention, a method of forming cants slabbed on four sides from logs, utilizing first and second in-line sets of pairs of saws, is provided. The method comprises the steps of feeding a log to the first set of saws in a given generally horizontal direction, the first set of saws slabbing two opposed sides of the logs; continuing feeding of the log from the first set of saws to the second set of saws substantially in said given horizontal direction, and rotating the log 90° about an axis along said given horizontal direction during feeding from the first set of saws to the second set of saws; and slabbing two opposed sides of the log with a second set of saws after 90° rotation of the log, to form a cant slabbed on four sides. The log is positively guided into engagement with both the first and second sets of saws, and is positively held down during cutting for safety and in order to effect clean cutting. The scrap formed by the slabbing is automatically conveyed from the saw sets in substantially the same direction as the log moves, to a disposal area. The distance between the pairs of circular saws in both the first and second saw sets is adjustable in the generally horizontal dimension transverse to said given direction by effecting automatic detented adjustment of the distance just prior to the log being received thereby. An operator watching the log being fed to a given saw set by eye guages the approximate dimensions of the log, and then pushes a button automatically moving the saws to a particular detented position desired, depending upon the log size. In this way, there is a minimum of waste while high rates of production can still be achieved.

The sawmill assembly according to the present invention comprises a pair of circular saws rotatable about a common horizontal axis and spaced from each other along the axis, said saws comprising a first set of saws, and a second set of saws being provided substantially identical to the first set of saws. A frame assembly mounts the first and second saws substantially in a generally horizontal dimension generally transverse to the axis of the first and second saw set pairs, and means are provided for feeding an article to be cut to the first saw set for feeding an article to be cut from the first saw set to the second saw set, in each case a main portion of the article passing through the space between the saws while side portions of the article are separated from the main portion. Additionally, means are provided for facilitating the rotation of the article 90° about an axis along said horizontal dimension, said facilitating means being disposed intermediate the first and second saw sets.

There are provided means for mounting the saws of each of the first and second saw sets for axial movement along the axis of rotation thereof, the power means associated with each saw set for effecting automatic detented adjustment of the distance between the saws. A first control panel is mounted adjacent the first saw set, and a second control panel is mounted adjacent the second saw set, the panels including the control means for operating the power means of the first and second saws respectively.

The means for facilitating the 90° rotation of each article comprises a plurality of powered screw rollers each rotatable about an axis parallel to the axis of rotation of the saws. A pair of guide walls mounted on the frame assembly are disposed vertically above and along either side of the powered screw rollers, and are elongated in said generally horizontal dimension. Centering means are disposed on both the upstream and downstream ends of the guide walls for centering the article as it enters and leaves the area defined by the guide walls. An operator standing at the rotation means waits until the log is substantially on the screw rollers, and then rotates the log 90° so that it turns and lays on one of the slabbed sides thereof, and then proceeds from the rotating means toward the second saw set.

The articles are fed through the sawmill assembly by a toothed chain conveyor running in channels, or between channel surfaces, extending substantially the length of the frame assembly. The toothed chain passes under the screw rollers and then returns to its original position, whereby the same chain conveyor can move the article being cut through the first set of saws and the second set of saws. Also, the powered screw rollers facilitate feeding of the partially slabbed log from the rotation facilitating means to the second saw set. A pair of scrap conveying conveyor belts are disposed outside of the saw sets and the rotation facilitating means, and may be powered by the same motor that powers the chain conveyor.

The articles to be acted upon by the sawmill assembly are indexed one at a time to the channel before the first saw set, to be ultimately engaged by a tooth of the toothed chain conveyor, in a direction parallel to the axis of rotation of the saws. Indexing means for accomplishing this comprise conveying means disposed vertically above the channel for conveying articles toward the channel, arm means disposed between the conveying means and the channel rotatable about an axis parallel to said generally horizontal dimension; and power means for rotating the arm means for engaging a single article on a conveying means and depositing it in the channel while simultaneously preventing movement of further articles on the conveying means toward the channel.

It is the primary object of the present invention to provide a method and apparatus which form cants slabbed on four sides in a simple manner, yet at a high rate of production. This and other objects of the invention will become clear from an inspection of the detailed description of the invention, and from the appended claims.

BRIEF DESCRIPTION OF THE DRAWINGS

FIG. 4 is a detail view looking into the centering means associated with the first saw set, partly in cross-section and partly in elevation;

FIGS. 6*a* and 6*b* are side and top plan views respectively of the log hold-down means associated with the first and second saw sets;

FIG. 7 is a side view, with the frame and near guide wall removed, of exemplary article rotation facilitating means according to the invention, in combination with exemplary article feeding means;

FIG. 9*a* is a perspective view of an exemplary log utilizable in practicing the method of the invention, and 9*b* is a perspective view of a cant slabbed on four side formed from the log of FIG. 9*a* by practicing the invention; and FIGS. 10*a* through 10*d* are schematic front end views of the various positions and configurations of a log as it is acted upon according to the method of the invention.

DETAILED DESCRIPTION OF THE DRAWINGS

Figure 1:
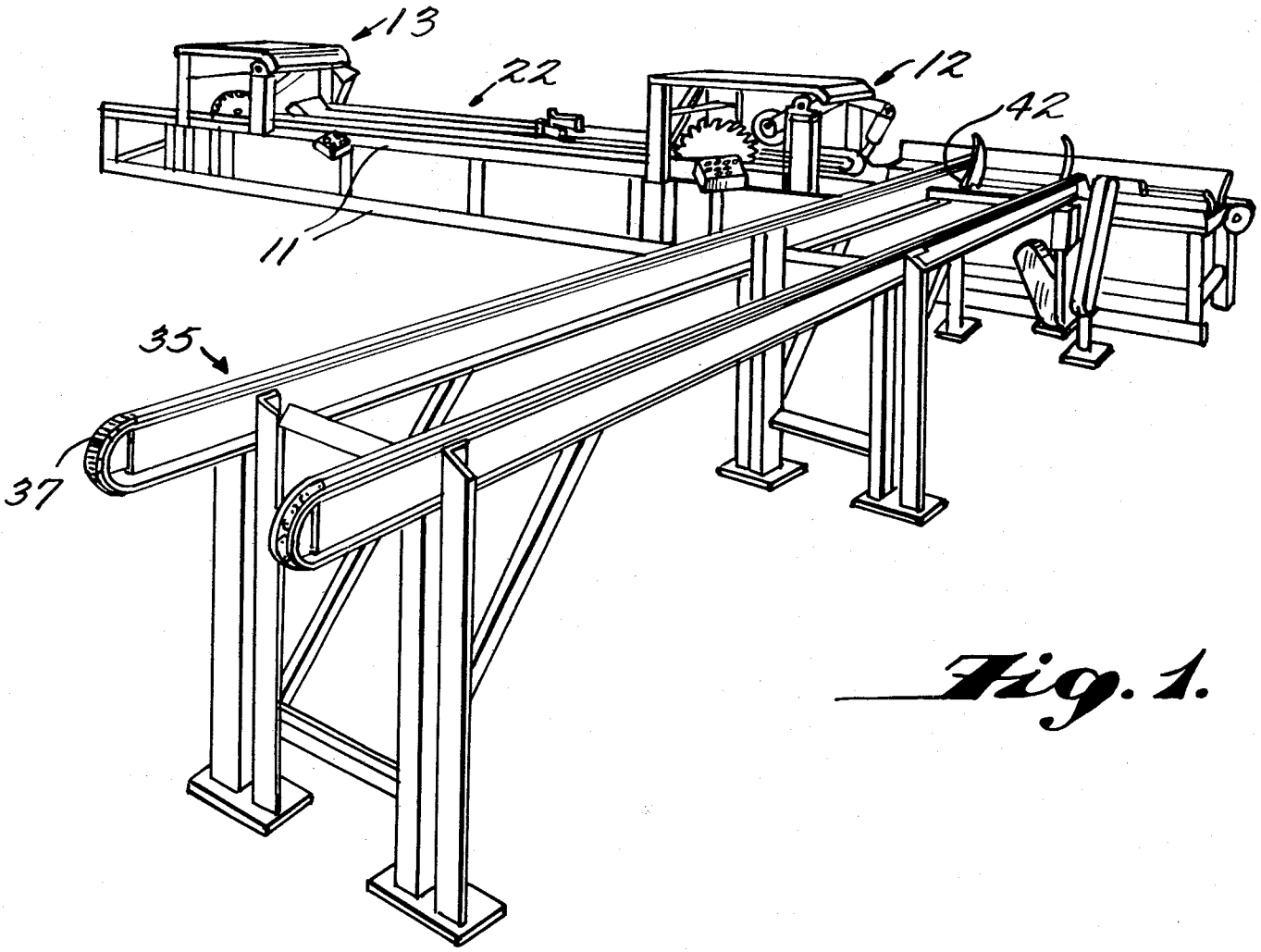
FIG. 1 is a perspective view of an exemplary sawmill assembly according to the present invention.
Figure 3:
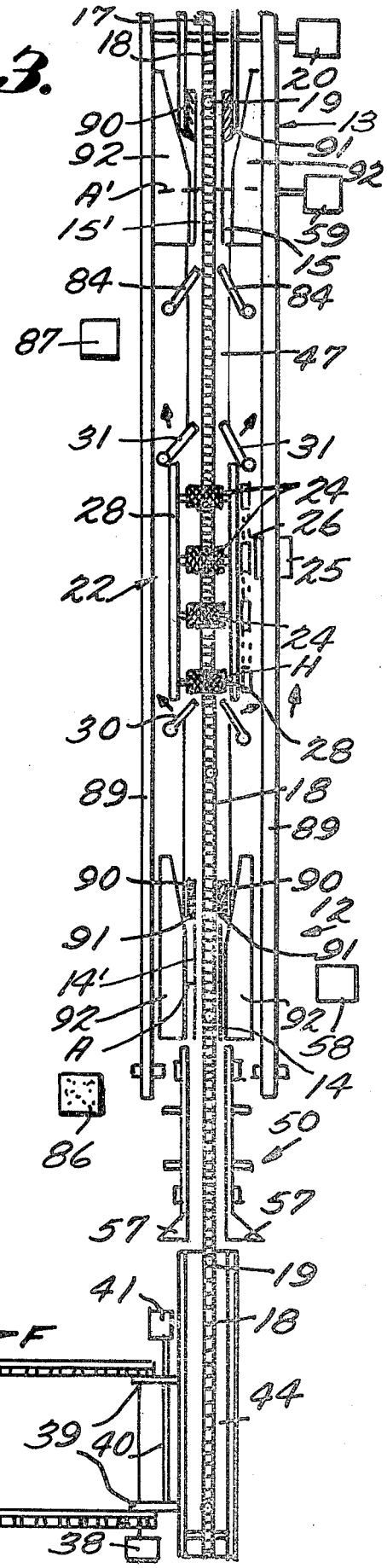
FIG. 3 is a top schematic view of the sawmill assembly of FIG. 1, with most portions of the frame assembly being removed for clarity.

An exemplary sawmill assembly according to the present invention is shown generally at 10 in the drawings (see FIGS. 1 and 3 in particular). The sawmill assembly 10 includes a first set of circular saws 12, a second set of circular saws 13, and a frame assembly 11 mounting the saw sets 12, 13 substantially in-line in a generally horizontally dimension H generally transverse to the axes of rotation A, A′ of the saws of the first and second saw sets 12, 13. The first saw set 12 includes a pair of circular saws 14, 14′ rotatable about the common horizontal axis A and spaced from each other along the axis A; the second saw set 13 comprises a pair of circular saws 15, 15′ rotatable about the common horizontal axis A′, and spaced from each other along the axis A′.

The sawmill assembly 10 further comprises means for feeding an article to be cut to the first saw set, and means for feeding an article to be cut to the second saw set. Preferably, such means comprise a common means 17, in each case a main portion of the article passing through the space between the saws while side portions of the article are separated from the main portion (see FIGS. 10*a* through 10*d*). The feeding means 17 preferably comprise a chain conveyor 18 having teeth 19 formed at predetermined positions along the length thereof. The teeth 19 will be spaced further apart than the average length of log to be acted upon by the assembly 10. A conventional motor 20 associated with a sprocket at one end of the chain 18 powers the chain 18 for feeding the logs first to the first saw set 12, and then to the second saw set 13.

Figure 2:
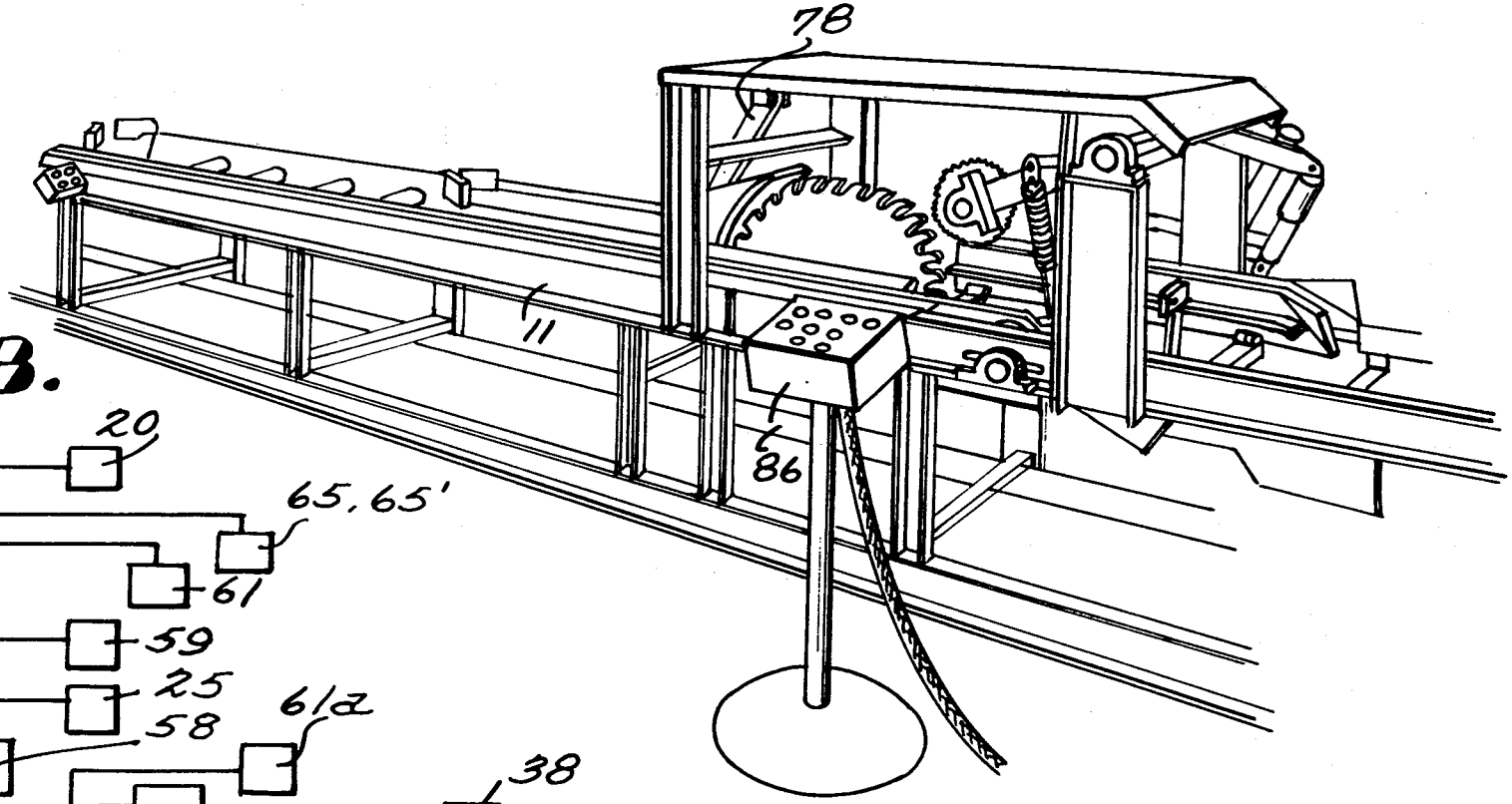
FIG. 2 is a detailed perspective view of the first saw set and rotation facilitating means of the sawmill assembly of FIG. 1.

The assembly 10 of the invention further comprises means 22 (see FIGS. 2, 3, and 7 in particular), for facilitating the rotation of the article being acted upon 90° about an axis along the horizontal dimension H, the rotation facilitating means 22 being disposed intermediate the first and second saw sets 12, 13, and being spaced from the first and second saw sets 12, 13 so that the distance from each saw set is greater than the average length of log to be acted upon by the assembly 10. The means 22 preferably comprises a plurality of powered screw rollers 24 each rotatable about an axis parallel to the axis of rotation of the saws 14, 14′, 15, 15′ (see FIG. 3 in particular). Preferably, a common conventional power source 25 powers all of the screw rollers 24 simultaneously, as through a chain and sproket arrangement 26. A pair of guide walls 28 are mounted on the frame assembly 11 and disposed vertically above and along either side of the powered screw rollers 24 (see FIGS. 2 and 7) and elongated in the generally horizontal dimension H. Centering means, such as pivoted metal flags 30, 31, are disposed on both upstream and downstream ends of the guide walls 28 for centering the article as it enters and leaves the area defined by the guide walls 28. The flags 30, 31 are spring-biased into the position illustrated in FIG. 3 by torsion springs 32, 33 (see FIG. 7), or the like, and are pivotal against the bias of the springs 32, 33 when a log passes therebetween.

Means for semi-automatically indexing the logs into operative association with the chain conveyor 18 to be conveyed toward the first saw set 12, are shown at 35 in FIGS. 1 and 3. The indexing means 35 feed the logs in the direction F (see FIG. 3), a horizontal direction perpendicular to the horizontal dimension H of feed of articles through the rest of the assembly 10. Preferably, the indexing means 35 comprises conveying means for conveying articles toward operative association with the conveyor chain 18, the conveyor means including a pair of spaced supports 36 and chain means 37 disposed on each of the supports and movable with respect to the supports 36, and power means 38 for moving the chain means 37 with respect to the supports 36 to move logs L thereon toward operative association with the chain conveyor 18. The indexing means 35 further comprise arm means 39 disposed between the conveying means 36, 37 and the chain conveyor 18, the arm means 39 rotatable about an axis defined by shaft 40, with power means 41 provided for rotating the arm means 39. The arm means 39 are so shaped, including the curved cam portion 42 (see FIG. 1), so that a single log L on the conveying means 36, 37 is deposited in operative association with the toothed chain conveyor 18 while the movement of further logs L is simultaneously prevented.

The article feeding means 17, in addition to the chain 18, powered by the motor 20, includes a series of channels with which the chain cooperates for feeding the articles toward the saw sets 12, 13. A first channel 44, which comprises a V-shaped trough, is positioned directly below the arm means 39 for receipt of an article therefrom. The article remains in the channel 44 until a tooth 19 of the chain 18 engages the rear end thereof, and moves it toward the first saw set 12. Throughout the length of the chain 18, a pair of channel portions 46 (see FIG. 4) are provided straddling the chain 18, on which the articles rest. Further, a second channel 47 (see FIG. 3) is provided formed by the frame assembly 11, operatively extending between the first saw set 12 and the second saw set 13, the second channel 47 being interrupted by the article rotation facilitating means 22.

From the channel 44, each log is fed to the first centering means 50 (see FIGS. 3 and 4 in particular). The centering means 50 comprises a pair of guide walls 51 elongated in the dimension H, and means for mounting the guide walls 51 so that they are pivoted at the bottoms 52 thereof to the frame assembly 11 and the tops thereof are normally spaced apart a relatively small distance but pivoted about the pivots 52 against the bias of a biasing means 53 to a position where the tops of the guide walls 51 are spaced apart the width of the article in that dimension. In other words, the walls 51 pivot from the solid line position of FIG. 4 to the dotted line position of FIG. 4, the actual extent of pivoting dependent upon the width of the article passing through the centering means 50. The biasing means 53 are operatively connected to the means 51 by any suitable arrangement, such as the first and second levers 54, 55, a stop 56 being provided in operative association with each lever 55 for preventing further inward movement of the guide walls 51 toward each other under the influence of the spring 53 past the solid line position in FIG. 4. The guide walls 51 have diverging end portions 57 (see FIGS. 2 and 3) which are engaged by a log L as it moves in direction H, effecting movement of the guide walls 51-against the bias of springs 53-being engaged.

In order to achieve high production rates, the saws of both saw sets 12, 13 are mounted so that the distance therebetween is changed by automatic detented adjustment, the operator merely activating a control mechanism just prior to an article coming into contact with the saws of either the saw set 12, 13, to position the saws in the most advantageous of 2, 3, or more possible positions, so that waste is minimized. The saw adjustment means will be specifically described with respect to FIG. 5, which shows a preferred embodiment for controlling the distance between the saws 15, 15' of the second saw set 13. It is to be understood, however, that a similar arrangement is provided for the first saw set 12, although preferably the saws 14, 14' of the first saw set 12—which are normally larger in diameter than the saws 15, 15' of the second saw set—are adjustable to one of two positions, while the saws 15, 15' are adjustable to one of three positions.

Figure 5:
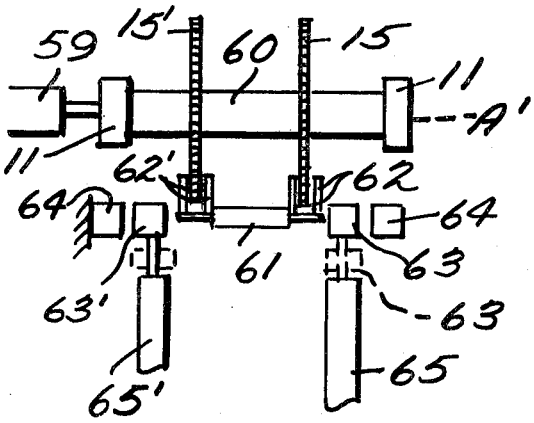
FIG. 5 is a schematic front view of the second saw set of the sawmill assembly of FIG. 1 showing the detented adjustment means associated therewith.

With particular reference to FIG. 5, the saws 15, 15' are mounted for axial movement along the axis A' by the splined shaft 60, each saw 15, 15' having a collar shaped to receive the splined shaft 60 so that the saws 15, 15' rotate with the shaft 60 under the power of a motor 59 (the first saw set 12 being powered by the motor 58), yet are axially moveable along the axis A'. Power means are associated with the saws 15, 15' for effecting automatic adjustment of the distance therebetween, the power means including a fluid-actuated cylinder assembly 61 operatively mounted to the frame assembly 11, and including a cylinder and a pair of rams, a roller 62, 62' being operatively attached to each ram straddling one of the saws 15, 15' respectively. A first stop 63, 63', is associated with each of the collars 62, 62' for stopping the outward axial movement thereof when the cylinder assembly 61 is supplied with actuating fluid. Thus, by merely pushing a button (for instance on control panels 86 or 87) the operator automatically effects adjustment of the saws from the position shown in FIG. 5 to a position wherein the collars 62, 62' abut the stop 63, 63'. In order to move the saws 15, 15' even more axially outward, second stops 64, 64', and pneumatic cylinder 65, 65' are provided. The pneumatic cylinder 65, 65' are mounted to the first stop 63, 63' respectively, and by supplying fluid to the cylinders 65, 65' the operator moves them out of interferring relationship with the collars 62, 62' (see the dotted line position of the stop 63, 63' in FIG. 5), the collars continue in rapid movement under the influence of cylinder assembly 61 until they abut the stops 64, 64'. In order to move the saws 15, 15' back to their original position, it is not only necessary for the operator to activate another control which feeds fluid from another source to the cylinder assembly 61 thereby moving the collars 62, 62' axially inwardly.

Figure 6B:
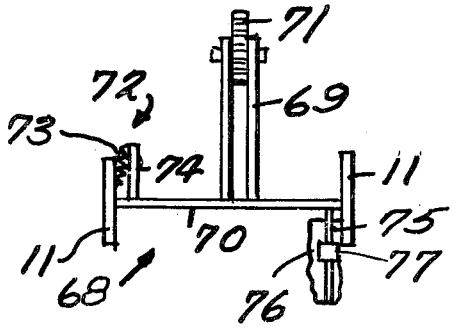

Associated with each saw set 12, 13, is an article hold-down means 68 (see FIGS. 2, 6*a* and 6*b* in particular) for preventing upward movement of the article while being cut. Each article hold-down means 68 comprises a first lever 69, means mounted to the lever 69 and the frame assembly 11 for allowing rotational movement of the lever 69 about an axis generally parallel to the axis of rotation of the saws, said means comprising a shaft 70; a toothed wheel 71 mounted to an end of the first lever 69 remote from the shaft 70 and adjacent the saws of the saw set 12, 13, with which the hold-down means 68 is associated, the toothed wheel 71 being vertically above the saws axis (A, A') and axially intermediate the saws; and biasing means 72 for biasing the toothed wheel 71 downwardly to a position for engaging the article just prior to and during cutting. The biasing means 72 preferably comprises a third lever 74, and a coil spring 73, the spring 73 being mounted between the third laver 74 and the frame 11, and the third lever 74 being rigidly attached to the shaft 70 (see FIG. 6*b* in particular). In order to provide positive return of the toothed wheel 71 to its desired position for acting upon the next log to be received by the respective saw set 12, 13, the hold-down means 68 preferably further comprises a second lever 75 fixedly mounted to the shaft 70 and extending therefrom in the opposite direction that the first lever 69 extends from the shaft 70, shock-absorber means 76 mounted between the second lever 75 and the frame assembly 11, and a stop 77 cooperating with the second lever 75 for stopping the movement thereof in the direction the second lever 75 tends to move under the action of the biasing means 72.

At the opposite end of the saws of each respective saw set 12, 13, as the article hold-down means 68, another article hold-down means 78 is provided, which may comprise a simple metal bar spaced a predetermined desired distance above the chain conveyor 18, the means 78 preventing movement of the log too far upwardly after it is cut by the saws of the respective saw sets 12, 13.

Since the article rotation facilitating means 22 is provided between the first and the second saw sets 12, 13, and since it is desirable to provide the same toothed chain conveyor 18 for conveying the logs to the first saw set 12, and from the means 22 to the second saw set 13, some means must be provided to prevent interferring engagement between the conveyor chain 18 and the rollers 24 of the means 22. While any suitable arrangement may be provided, one such arrangement is shown schematically in FIG. 7, comprising a plurality of brackets 82 engaging both sides of the chain 18—and preferably both the top and bottom thereof—on the periphery thereof so as not to interfere with the teeth 19 thereon, the brackets 80 being arranged to guide the chain 18 below and out of interferring engagement with the rollers 24. A suitable sprocket 81 or the like is then provided at the downstream end of the article turning facilitating means 22 to bring the chain 18 back up to position wherein a tooth 19 of the chain 18 engages the log L after passing past the 1st roller 24 to move it toward the second saw set 13. Flag centering means 84 (see FIG. 3) substantially the same as the flags 30, 31, are provided immediately in front of the saws 15, 15' to insure that the articles fed to the second saw set 13 are properly aligned.

Since scraps (see W, W' in FIGS. 10*b* and 10*d*) are formed during slabbing of the logs L by the sawmill assembly 10, some manner must be provided to dispose of the scraps without affecting operation of the sawmill assembly 10. A preferred scrap disposal means according to the present invention comprises a pair of conveyor belts 89 (i.e., rubber conveyor belts) mounted on the frame assembly 11 and extending in straight lines from outside the saws of the first saw set 12 to outside the saws of the second saw set 13 (see FIG. 3). A pair of uprights 90 are associated with each saw set immediately downstream of the saws of that set, and having outwardly angled front portions 91 thereof directing the scraps W, W', outwardly toward the conveyors 89 as the scraps W, W' are being cut. The scrap disposal means further comprises a pair of metal directing means 92 associated with each saw set 12, 13, the means 92 being elongated in the horizontal dimension H, and disposed between the outsides of the saws and uprights 90 of the saw set 12, 13, with which they are associated and the conveyor belts 89, the metal directing means 92 directing the scraps from the uprights 90 on to the conveyor belts 89. The conveyor belts 89 are preferably powered by the same motor 20 that powers the toothed chain 18, and the scraps are carried the entire length of the sawmill assembly 10 and are ultimately disposed of at the ned of the conveyor belts 89. A worker may stand at the end of the sawmill assembly 10 and remove the scraps and the cant C formed, or any suitable automatic scrap disposal and article receiving means may be provided.

Figure 8:
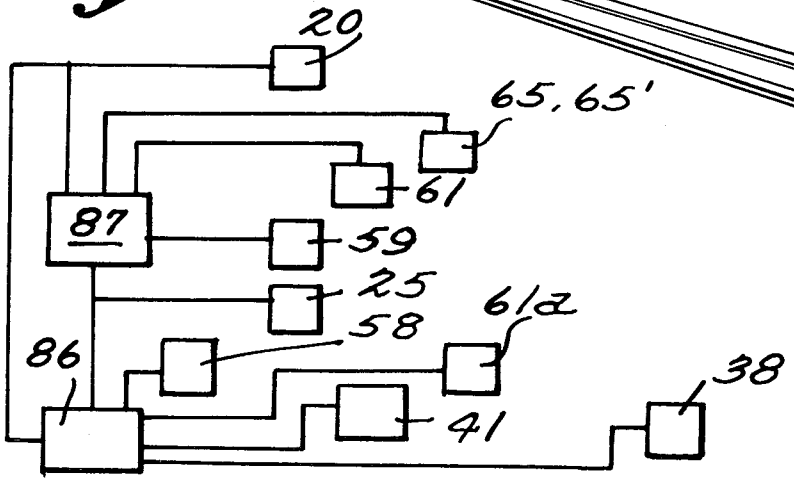
FIG. 8 is a box diagram indicating the control connections between the control panels and the power supplying components associated with the sawmill assembly.

Preferably a pair of control panels, 86, 87, (see FIGS. 1, 3 and 8 in particular) are provided whereby an operator may control the various power components. For instance, an operator standing by control panel 86 is able to control the motor 38 for powering the chains 36 (which motor 38 may be automatically keyed to the motor 41), the motor 41 for rotating the arms 39 to deposit a log L in the channel 44, the first saw set 12 motor 58, and the fluid actuated cylinder 61*a* for effecting detented adjustment of the space in between the saws 14, 14'. Additionally, the control panel 86 also preferably includes controls for the article rotation facilitating means motor 25 and the article feeding means motor 20. The second control panel 87, located just before the second saw set 13, includes controls for the second saw set motor 59, the fluid cylinder 61 for effecting detented adjustment of the distance between the saws 15, 15', a control for the pneumatic cylinders 65, 65' which also determine the axial position of the saws 15, 15', and preferably controls for the motors 20, 25. Operators at control panels 86, 87 are in excellent position to anticipate hazards that may occur, feed logs to the system at a proper rate, gauge the dimensions of the logs being cut to properly position the saws to minimize waste, and the control panel 87 is mounted so that one worker may turn the logs on the rollers 24 and operate the second saw set 13. Additionally, the controls 86, 87 may be arranged as desired so that an operator standing at the first contrl panel 86 also controls the spacing of the saws 15, 15' of the second saw set 13.

Method

According to the present invention, a method of forming cants slabbed on four sides from logs is provided utilizing first and second in-line sets of pairs of saws 12, 13, the method being described in detail with respect to the drawings of the sawmill assembly 10, and in particular with reference to FIGS. 9*a* and 9*b* and FIGS. 10*a* through 10*d*.

A log L is fed in direction F from the arms 39 onto the trough 44 by actuation of the motor 41 which moves arms 39 to dump a log received thereby on channel 44. A tooth 19 of the chain 18 then engages the rear of the log L and moves it in direction H toward the first saw set 12. The first saw set 12 slabs two sides S of the log L as seen in FIG. 10*b*, the scrap portions W engaging the angled edge 91 of the uprights 90, and then being directed by the metal directing means 92 onto the rubber conveyors 89 to be transported in direction H to a disposal area. The log L is centered by the centering mechanism 50 before entering the first saw set 12, and is held down during cutting by the hold-down means 68 associated with the first saw set 12.

The method includes the further steps of continuing feeding of the log L from the first set of saws toward the second set of saws substantially in the direction H, and rotating the log 90° about an axis along the direction H during feeding from the first set 12 to the second set 13, the rotation being effected at the article rotation facilitating means 22. The log L passes through the flags 30 onto the rollers 24, the rollers 24 biting in somewhat to the log and effecting conveyance of the log in direction H while the chain 18 passes below the means 22. When the log is properly positioned on rollers 24, the operator turns the log over on its side—if it does not turn by itself—so that one of the slab sides S of the log is in engagement with the rollers 24, and then the log passes through the flags 31 toward the second saw set 13, a tooth 19 of the chain 18 again coming up to engage the log and feed it toward the second saw set 13.

The method comprises the further step of feeding the log through the centering means 84 to the second saw set 14, and slabbing two opposed sides S' (see FIG. 10*d* ) of the log with the second set of saws 13 after a 90° rotation of the log, to form the final cant C (see FIGS. 10*d* and 9*b*) which is slabbed on four sides. The hold-down means 68 associated with the second saw set 13 holds the log down during cutting, and the waste portions W' are disposed of by the uprights 90, directing means 92, and belts 89 associated with the second set 13 in the same way that the scraps W were disposed off at the first saw set 12.

Just prior to the log moving into engagement with the saws of the first saw set, and again just prior to the log moving into engagement with the saws of the second saw set 13, an operator actuates a suitable control on control panel 86 or 87 to adjust the axial spacing of the respective saws, automatic detented axial adjustment of their position being effected. For many uses, the saws 14, 14' will be mounted so that they are moveable between 4 inch and 6 inch spacings, while the saws 15, 15' are moveable so that they may be spaced 4 inches, 6 inches, or 8 inches.

Thus, it will be seen that according to the present invention a method of forming cants slabbed on four sides from logs—and a sawmill assembly for practicing the same—has been provided which facilitates simple, high rate of production formation of cants. While the invention has been herein shown and described it is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent methods and assemblies.

What is claimed is:

1. A sawmill assembly comprising a pair of circular saws rotatable about a common horizontal axis and spaced from each other along said axis, said saws comprising a first set of saws;

a second set of saws substantially identical to said first set of saws;

a frame assembly mounting said first and second saws substantially in-line in a generally horizontal dimension generally transverse to said axes of said first and second saw set pairs;

means for feeding an article to be cut to said first saw set, a main portion of the article passing through the space between said saws of said first saw set, and side portions of the article being separated from the main portion;

means for feeding an article to be cut to said second saw set, a main portion of the article passing through the space between said saws of said second saw set, and side portions of the article being separated from the main portion;

means for facilitating the rotation of the article 90° about an axis along said horizontal dimension, said means being disposed intermediate said first and second saw sets;

means for mounting said saws of each of said first and second saw sets for axial movement along said axes of rotation thereof, said means comprising a common splined shaft received by an interior collar of each of said saws;

and power means associated with each saw set for effecting automatic detented adjustment of the distance between said saws, said power means comprising a fluid-actuated cylinder assembly operatively mounted to said frame assembly and including a cylinder and a pair of rams, a collar operatively attached to each ram straddling one of the saws of the respective saw set, and a stop operatively attached to said frame assembly for limiting the movement of each of said collars.

2. A sawmill assembly as recited in claim 1 wherein said second saw set has two stops operatively attached to said frame assembly associated with each of said rams of said cylinder assembly of said second saw set, said stops comprising first and second stops, said first stop being disposed between said cylinder assembly and said second stop, and further comprising automatically actuated means for selectively moving said first stop out of the path of movement of the ram associated therewith.

3. A sawmill assembly as recited in claim 1 further comprising a first control panel mounted adjacent said first saw set, and a second control panel mounted adjacent said second saw set, said first control panel including control means for operating said power means for axially moving the saws of said first saw set, and said second control panel including control means for operating said power means for axially moving the saws of said second saw set.

4. A sawmill assembly comprising a pair of circular saws rotatable about a common horizontal axis and spaced from each other along said axis, said saws comprising a first set of saws;

a second set of saws substantially identical to said first set of saws;

a frame assembly mounting said first and second saws substantially in-line in a generally horizontal dimension generally transverse to said axes of said first and second saw set pairs;

means for feeding an article to be cut to said first saw set, a main portion of the article passing through the space between said saws of said first saw set, and side portions of the article being separated from the main portion;

means for feeding an article to be cut to said second saw set, a main portion of the article passing through the space between said saws of said second saw set, and side portions of the article being separated from the main portion; and means for facilitating the rotation of the article 90° about an axis along said horizontal dimension, said means being disposed intermediate said first and second saw sets, said means comprising a plurality of powered screw rollers, each rotatable about an axis parallel to the axis of rotation of said saws.

5. A sawmill assembly as recited in claim 4 further comprising means for mounting said saws of each of said first and second saw sets for axial movement along said axes of rotation thereof, and power means associated with each saw set for effecting automatic detented adjustment of the distance between said saws.

6. A sawmill assembly as recited in claim 4, wherein said rotation facilitating means further comprises a pair of guide walls mounted on said frame assembly and disposed vertically above and along either side of said powered screw rollers, and elongated in said generally horizontal dimension, and centering means disposed on both the upstream and downstream ends of said guide walls for centering the article as it enters and leaves the area defined by said guide walls.

7. A sawmill assembly as recited in claim 4 further comprising first article hold-down means for preventing upward movement of the article while being cut with said first saw set, and corresponding second article hold-down means for said second saw set;

each of said article hold-down means comprising a first lever, means mounted to said lever and to said frame assembly for allowing rotational movement of said lever about an axis generally parallel to said axis of rotation of said saws; a toothed wheel mounted to an end of said first lever remote from said rotational movement allowing means and adjacent the saws of the saw set with which said hold-down means is associated, said toothed wheel being vertically above the saws axis, and axially intermediate the saws; and biasing means for biasing said toothed-wheel end of said first lever downwardly to a position for engaging the article just prior to and during cutting.

8. A sawmill assembly as recited in claims 1 or 4 further comprising first centering means for centering the article just before it moves into engagement with said first saw set;

said first centering means comprising a pair of guide walls elongated in said generally horizontal dimension and having diverging end portions for first receiving the article; and means for mounting said guide walls so that they are pivoted at the bottoms thereof to said frame assembly, and the tops thereof are normally spaced apart a relatively small distance but pivot about their bottoms, against the bias of a biasing means, to a position wherein the tops are spaced apart the width of the article in that dimension.

9. A sawmill assembly as recited in claims 1 or 4, wherein said means for feeding an article to be cut to said first saw set comprises a first channel formed by said frame assembly leading to said first saw set, a toothed chain conveyor running in said first channel, and means for powering said chain so that the teeth thereof may engage an article disposed in said first channel and carry it toward said first saw set.

10. A sawmill assembly as recited in claim 9, further comprising means for indexing articles one at a time to said first channel to be ultimately engaged by a tooth of said toothed chain converyor and carried toward said first saw set, said indexing being in a direction parallel to said axes of rotation of said saws; said indexing means comprising conveying means disposed vertically above said first channel for conveying articles toward said first channel, arm means disposed between said conveying means and said first channel and rotatable about an axis parallel to said generally horizontal dimension, and power means for rotating said arm means for engaging a single article on said conveying means and depositing it in said first channel while simultaneously preventing movement of further articles of said conveying means toward said first channel.

11. A sawmill assembly as recited in claim 10 wherein said conveying means of said indexing means comprises a pair of spaced supports, and chain means disposed on each of said supports and moveable with respect to said supports, and power means for moving said chain means with respect to said supports to move articles thereon toward said first channel.

12. A sawmill assembly comprising a pair of circular saws rotatable about a common horizontal axis and spaced from each other along said axis, said saws comprising a first set of saws;

a second set of saws substantially identical to said first set of saws;

a frame assembly mounting said first and second saws substantially in-line in a generally horizontal dimension generally transverse to said axes of said first and second saw set pairs;

means for feeding an article to be cut to said first saw set, a main portion of the article passing through the space between said saws of said first saw set, and side portions of the article being separated from the main portion;

means for feeding an article to be cut to said second saw set, a main portion of the article passing through the space between said saws of said second saw set, and side portions of the article being separated from the main portion;

means for facilitating the rotation of the article 90° about an axis along said horizontal dimension, said means being disposed intermediate said first and second saw sets; and first article hold-down means for preventing upward movement of the article while being cut with said first saw set, and corresponding second article hold-down means for said second saw set; each of said article hold-down means comprising a first lever, means mounted to said lever and to said frame assembly for allowing rotational movement of said lever about an axis generally parallel to said axis of rotation of said saws; a toothed wheel mounted to an end of said first lever remote from said rotational movement allowing means and adjacent the saws of the saw set with which said hold-down means is associated, said toothed wheel being vertically about the saws' axis, and axially intermediate the saws; and biasing means for biasing said toothed-wheel end of said first lever downwardly to a position for engaging the article just prior to and during cutting.

13. A sawmill assembly as recited in claim 12 wherein each said article hold-down means rotational movement allowing means comprises a shaft, and wherein said hold-down means further comprises a second lever fixedly mounted to said shaft and extending therefrom in the opposite direction as said first lever; shock absorber means mounted between said second lever and said frame assembly; and a stop cooperating with said second lever for stopping the movement thereof in the direction said second lever tends to move under the action of said biasing means.

* * * * *